United States Patent [19]

Buchholz et al.

[11] Patent Number: 5,012,983

[45] Date of Patent: May 7, 1991

[54] PERFORATED PLATE FOR A FUEL INJECTION VALVE

[75] Inventors: Juergen Buchholz, Lauffen/Neckar; Martin Maier, Moeglingen, both of Fed. Rep. of Germany

[73] Assignee: Robert Bosch GmbH, Stuttgart, Fed. Rep. of Germany

[21] Appl. No.: 446,830

[22] Filed: Dec. 6, 1989

[30] Foreign Application Priority Data

Feb. 15, 1989 [DE] Fed. Rep. of Germany ..... 3904446

[51] Int. Cl.[5] ..... B05B 1/04

[52] U.S. Cl. ..... 239/590.5; 239/533.12; 239/553.5; 239/585

[58] Field of Search ..... 239/533.3–533.12, 239/585, 553.5, 590.5

[56] References Cited

U.S. PATENT DOCUMENTS

| | | | |
|---|---|---|---|
| 1,589,238 | 6/1926 | Scott | 239/533.6 |
| 4,646,974 | 3/1987 | Sofianek et al. | 239/585 |
| 4,699,323 | 10/1987 | Rush et al. | 239/585 |
| 4,903,898 | 2/1990 | Kind | 239/585 |

FOREIGN PATENT DOCUMENTS

| | | | |
|---|---|---|---|
| 3640830 | 6/1988 | Fed. Rep. of Germany | 239/585 |

*Primary Examiner*—Andres Kashnikow
*Assistant Examiner*—Michael J. Forman
*Attorney, Agent, or Firm*—Edwin E. Greigg; Ronald E. Greigg

[57] ABSTRACT

A perforated plate that provides an improvement in a fuel injection valve that is used to inject fuel into the intake tube of a mixture-compressing internal combustion engine having externally supplied ignition. The perforated plate is secured on a nozzle body of a fuel injection valve, in which a tight-seat face is embodied. Cooperating with the tight-seat face is a valve needle, to which an armature is secured, which is actuated electromagnetically by a magnetic coil. The perforated plate is secured downstream of the tight-seat face, and is provided with opposite disposed elongated indentations each of which slope toward and discharge into a cylindrical hole in order to form fanlike streams that are ejected through the cylindrical hole.

9 Claims, 2 Drawing Sheets

PERFORATED PLATE FOR A FUEL INJECTION VALVE

BACKGROUND OF THE INVENTION

The invention relates to a perforated plate for a fuel injection valve. It is known to dispose a small plate having bores in fuel injection valves downstream of the valve seat face; the atomization of the fuel is then performed by this plate. Usually, these small plates include a plurality of bores. It is also known to provide these bores at an angle to the valve axis, or to provide an annular groove in one face of the plate, from which groove the various bores then extend, but the various bores produce cordlike streams and hence result in relatively poor atomization.

OBJECT AND SUMMARY OF THE INVENTION

The present invention has an object of generating flat or fanlike streams for atomizing the fuel, in order to obtain better atomization.

According to the invention, because of the shape of the inlet pattern in the perforated plate, two halves of a fuel flow are formed, and the two halves are directed toward one another directly upstream of a cylindrical hole, so that despite the ensuing cylindrical cross section of the hole, a fanlike stream can be produced. By varying the inlet geometry, for instance the depth, angle and so forth of the inlet, both the shape of the stream and the angle and distribution of the stream can be varied in a simple fashion. By combining a plurality of fanlike streams in one perforated plate, single-stream valves with full conical distribution and two- and three-stream valves can all be produced, all of which provide better preparation than previously known valves. A simple, way of shaping the stream will be set forth hereinafter, and the invention can be used directly for massproduction of injection valves.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
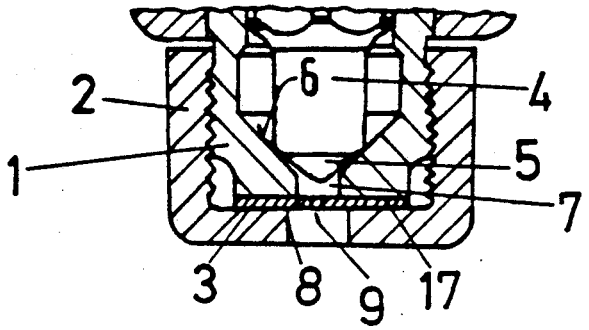
FIG. 1 shows the lowermost part of an injection valve.

FIG. 1 shows the lower end, for example, of a fuel injection valve for a fuel injection system of a mixture-compressing internal combustion engine with externally supplied ignition. A fuel injection valve of this type is described and shown in U.S. application Ser. No. 310,025 filed Feb. 10, 1989 which has been allowed and which is a continuation of application Ser. No. 124,526 filed Nov. 24, 1987 now abandoned which is expressly incorporated by reference here. As FIG. 1 shows, a retaining sleeve 2 is threaded onto a nozzle body 1, and the nozzle body 1 has a tight-seat face 6, which together with a cone 5 of a valve needle 4 forms the actual valve. Downstream of the tight-seat face 6 in the nozzle body 1 is a collection bore 7, which comes to an end at one end face 17 of the nozzle body 1. A thin perforated plate 3 that has at least one hole 9 is clamped in place, vertically to the valve axis, between the end face 17 of the nozzle body 1 and the retaining sleeve 2. The fuel stream or streams then emerge via this hole or holes 9 and in so doing pass through a bore 8 in the retaining sleeve 2.

Figure 2:
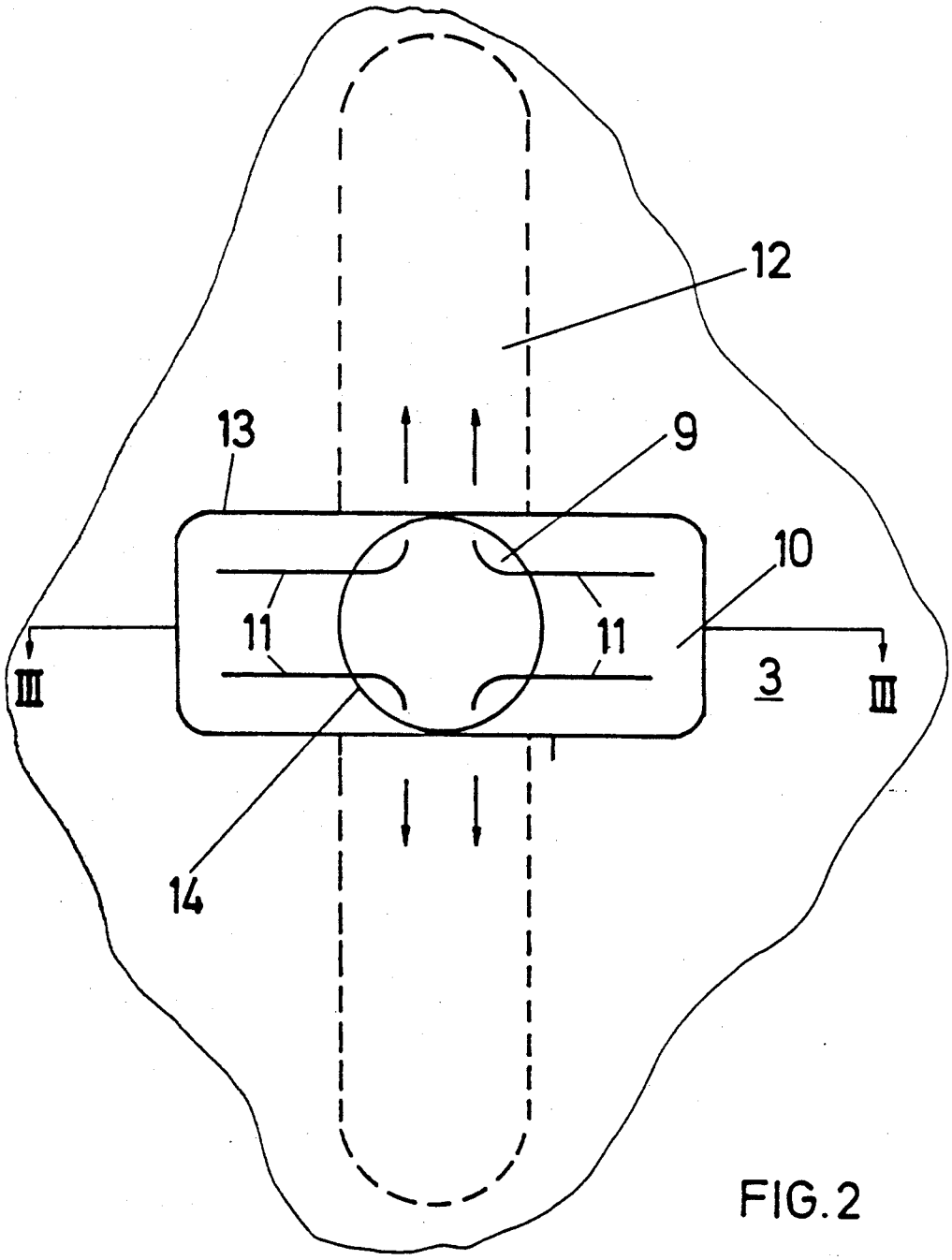
FIG. 2 is a plan view of a perforated plate embodied in accordance with the invention.
Figure 3:
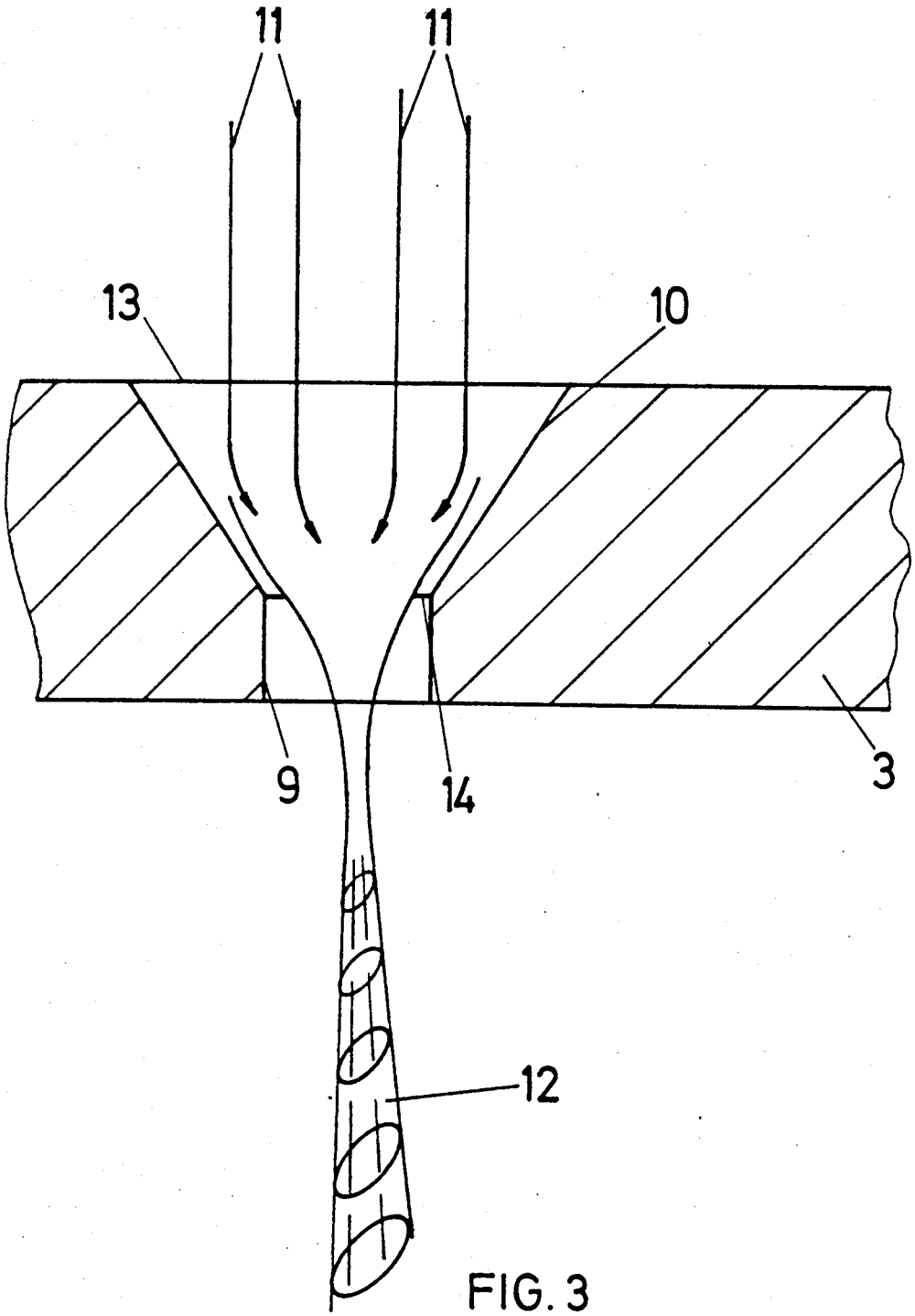
FIG. 3 is a cross sectional view taken along the line III—III of FIG. 2.

The invention is shown in further detail in FIGS. 2 and 3, which show a perforated plate 3 having a single hole 9. However it is understood that the perforated plate 3 may have a plurality of such holes. On its side toward the nozzle body 1, respective elongated indentations 10 are provided in the perforated plate 3, which are open toward the collective bore 7; the indentations 10, facing one another, discharge into the cylindrical hole 9. For each indentation 10, its outer edge 13 extending in the flow direction approximately communicates on both sides with the edge 14 of the cylindrical hole 9, and as the drawings show the width of the indentation 10 is approximately equal to the corresponding diameter of the cylindrical hole 9 such that the outer edge 13 is tangent with the hole 9. The course of the indentations 10 from the upper surface of the perforated plate 3 to the hole 9 is preferably inclined, as FIG. 3 shows. The holes 9 are preferably in the form of circular cylinders.

For better comprehension, lines of flow 11 are shown in FIGS. 2 and 3. It can be seen that in the two oppositely disposed indentations 10 facing one another, the lines of flow 11 are directed toward the center axis of the hole, where they meet, and the flow direction is then deflected by 90°, resulting in a fanlike stream 12, represented by dashed lines, that emerges from the hole 9 and is oriented vertically with respect to the longitudinal axis of the indentations 10. Since there is a flatter fluid lamina at the outlet from the hole here than is the case with cordlike streams, the atomization of the fuel supplied is increased substantially. As already mentioned, the stream shape or in other words the stream angle and distribution and the like can be varied in a simple manner by varying the inlet geometry, i.e., the depth of the indentations. By combining a plurality of fanlike streams 12, both single-stream valves with fully conical distribution and two- and three-stream valves can be produced.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A perforated plate for a fuel injection valve in fuel injection systems of internal combustion engines, in which said perforated plate is disposed downstream of and displaced from a valve seat face provided in a nozzle body, said perforated plate includes at least one cylindrical hole therein, at least one pair of oppositely disposed elongated indentations (10) are provided in said perforated plate (3), said elongated indentations (10) are formed on a side of said perforated plate (3) oriented toward said nozzle body (1) and valve seat face, each of said at least one pair of oppositely disposed indentations slope on an incline from their outer edges downwardly to meet an outer surface of at least one of said at least one cylindrical hole, and each of said at least one pair of oppositely disposed elongated indentations discharge into at least one of said at least one cylindrical hole (9).

2. A perforated plate as defined by claim 1, in which, each of said at least one cylindrical hole (9) is circular-cylindrical in shape.

3. A perforated plate as defined by claim 2 in which each said oppositely disposed elongated indentations (10) have a width that is approximately equivalent to the corresponding diameter of said at least one cylindrical hole (9).

4. A perforated plate as defined by claim 3 in which each said oppositely disposed elongated indentation (10) includes outer edges (13) which communicate approximately with the circumference (14) of each of said at least one associated cylindrical hole (9).

5. A perforated plate as defined by claim 2 in which each said oppositely disposed elongated indention (10) includes outer edges (13) which communicate approximately with the circumference (14) of each of said at least one associated cylindrical hole (9).

6. A perforated plate as defined by claim 1 in which each said oppositely disposed elongated indentations (10) have a width that is approximately equivalent to the corresponding diameter of said at least one cylindrical hole (9).

7. A perforated plate as defined by claim 6 in which each said oppositely disposed elongated indentation (10) includes outer edges (13) which communicate approximately with the circumference (14) of each of said at least one associated cylindrical hole (9).

8. A perforated plate as defined by claim 1 in which each oppositely disposed elongated indentation (10) includes outer edges (13) which communicate approximately with the circumference (14) of each of said at least one associated cylindrical hole (9).

9. A perforated plate as defined in claim 1 in which said at least one cylindrical hole is axially aligned with a longitudinal axis of said nozzle body.

* * * * *